US010053115B2

(12) United States Patent
Cylvick

(10) Patent No.: US 10,053,115 B2
(45) Date of Patent: Aug. 21, 2018

(54) INTEGRATED BOLLARD, ANCHOR, AND TOWER (IBAT) APPARATUS AND METHOD

(71) Applicant: ZIPHOLDINGS, LLC, Wanship, UT (US)

(72) Inventor: Eric S. Cylvick, Wanship, UT (US)

(73) Assignee: ZIPHOLDINGS, LLC, Wanship, UT (US)

( * ) Notice: Subject to any disclaimer, the term of this patent is extended or adjusted under 35 U.S.C. 154(b) by 491 days.

(21) Appl. No.: 14/711,465

(22) Filed: May 13, 2015

(65) Prior Publication Data

US 2016/0096532 A1 Apr. 7, 2016

Related U.S. Application Data

(60) Provisional application No. 62/058,544, filed on Oct. 1, 2014.

(51) Int. Cl.

| | |
|---|---|
| ***B61B 12/00*** | (2006.01) |
| ***B61B 7/02*** | (2006.01) |
| ***B61B 7/00*** | (2006.01) |
| ***B61B 7/04*** | (2006.01) |
| ***B61B 7/06*** | (2006.01) |

(52) U.S. Cl.

CPC ..... *B61B 12/007* (2013.01); *B61B 7/00* (2013.01); *B61B 7/02* (2013.01); *B61B 7/04* (2013.01); *B61B 7/045* (2013.01); *B61B 7/06* (2013.01)

(58) Field of Classification Search

CPC .... B61B 7/00; B61B 7/02; B61B 7/04; B61B 7/045; B61B 7/06; B61B 12/007

See application file for complete search history.

(56) References Cited

U.S. PATENT DOCUMENTS

| | | | | | |
|---|---|---|---|---|---|
| 703,222 | A * | 6/1902 | Alexander | B61B 7/02 | 104/117 |
| 2,691,478 | A * | 10/1954 | Frankel | A62B 35/04 | 182/113 |
| 4,287,963 | A * | 9/1981 | Coxsey | A62B 1/12 | 182/231 |
| 5,134,571 | A * | 7/1992 | Falque | B61B 12/007 | 104/173.1 |
| 5,216,973 | A * | 6/1993 | Gwinn | B63B 25/082 | 114/229 |
| 5,218,805 | A * | 6/1993 | Rex | E01F 8/0023 | 256/24 |

(Continued)

FOREIGN PATENT DOCUMENTS

| | | | | |
|---|---|---|---|---|
| WO | WO-2017035672 A1 * | 3/2017 | ..... | A01D 46/20 |

*Primary Examiner* — Robert J McCarry, Jr.
*Assistant Examiner* — Scott A Browne
(74) *Attorney, Agent, or Firm* — Pate Baird, PLLC

(57) ABSTRACT

An integrated bollard, anchor, and tower (IBAT) system constructed as a single monolith may be formed of a single material, such as concrete or steel, or assembled from components of distinct materials, such as reinforced concrete with metal brackets, fixtures, fasteners, and so forth. An anchor (e.g., base, pad), sized to engage the ground therebelow by weight and friction, includes a mass sufficient to provide frictional stability (no appreciable movement) of the IBAT unit at each end of a track line (cable, wire rope, line, etc.), which wraps around the bollard portion of each upright (tower, fin) portion at an operational height defining the path of a trolley carried on the free span of the resulting catenary.

20 Claims, 9 Drawing Sheets

(56) References Cited

U.S. PATENT DOCUMENTS

| | | | | |
|---|---|---|---|---|
| 6,036,146 | A * | 3/2000 | Paterson | A62B 35/0056 182/113 |
| 6,666,773 | B1 * | 12/2003 | Richardson | A63G 21/22 104/204 |
| 8,708,109 | B2 * | 4/2014 | Steele | A63G 21/22 104/113 |
| 9,415,780 | B2 * | 8/2016 | Gustafson | B61B 7/00 |
| 2002/0162477 | A1 * | 11/2002 | Palumbo | B61B 7/00 104/87 |
| 2007/0181767 | A1 * | 8/2007 | Wobben | E02D 27/42 248/346.01 |
| 2011/0135400 | A1 * | 6/2011 | Hall | E02D 27/42 405/228 |
| 2014/0182477 | A1 * | 7/2014 | Gustafson | B61B 7/00 104/113 |

* cited by examiner

INTEGRATED BOLLARD, ANCHOR, AND TOWER (IBAT) APPARATUS AND METHOD

RELATED APPLICATIONS

This application claims the benefit of U.S. Provisional Patent Application Ser. No. 62/058,544 filed Oct. 1, 2014, entitled INTEGRATED TOWER, BOLLARD, AND ANCHOR APPARATUS AND METHOD, which is hereby incorporated by reference in its entirety. This application also hereby incorporates by reference: U.S. Pat. No. 7,637,213, issued Dec. 29, 2009; U.S. Pat. No. 7,966,940, issued Jun. 28, 2011; U.S. Pat. No. 7,299,752, issued Nov. 27, 2007; U.S. Pat. No. 7,404,360, issued Jul. 29, 2008; U.S. Pat. No. 6,622,634, issued Sep. 23, 2003; U.S. Pat. No. 6,666,773, issued Dec. 23, 2003; U.S. Pat. No. 8,191,482, issued Jun. 5, 2012; U.S. Pat. No. 8,333,155, issued Dec. 18, 2012; and U.S. patent application Ser. No. 14/451,932, filed Aug. 5, 2014.

BACKGROUND

1. Field of the Invention

This invention relates to trams for carrying vehicles such as gondolas, chairs, and harnesses on trollies rolling along track lines, and, more specifically to bollard, anchoring, and tower systems for supporting track lines.

2. Background Art

Trams may have a moving line that supports and drives lift chairs, as in ski lifts. They may instead ride on a stationary track line suspended over towers installed between anchors at each end. The track line may suspend freely as a catenary or pass over intermediate towers. The track line may support the weight, while a haul line connected to the vehicle (tram, car, seat, gondola, trolley, or other carrier of people, articles, or materials) actually controls speed and provides the motive force to move the vehicle. It would be an advance in the art to create an end-of-line, anchoring system, for securing each end of a track line, while presenting a reduced profile imposing on the surrounding environment. This is particularly true for a zip line installation, such as a multiple-leg system of lines in a remote or scenic "tour" installation.

SUMMARY OF THE INVENTION

A trolley travels on a track line between two units that each constitutes a unitary, integrated, bollard, anchor, and tower (IBAT) system in a single monolith. The monolith may be formed of a single material, such as concrete or steel. It may also be assembled from components of distinct materials.

However, in one embodiment of an apparatus and method in accordance with the invention, the system includes an anchor portion sized to provide engagement with the ground below and having a mass and weight sufficient to provide frictional stability, meaning no appreciable movement of the integrated tower-bollard-anchor unit at each end. Meanwhile, the track line is wrapped around the bollard portion, extending from the tower portion at a proper height for operation. The tower portion extends upward from the anchor portion on the underlying surface of the ground supporting it.

The track line extends from the bollard on the top unit to the bollard on the bottom unit. Typically, the track line is a catenary in a free span between the upper bollard and lower bollard. The tower is a concrete fin extending up from a concrete foundation or pad. The pad is sized in horizontal area and vertical thickness to have a mass suitable to render the unit immovable against all loads contemplated to be exerted on the unit by the track line in use.

The tower may be poured with the pad, or may be poured on the pad, with suitable rebar connections. Also, the bollard may be poured with the fin or may be secured to bolts secured into the concrete of the fin-like tower. The anchor (pad), tower (fin), and bollard are all fixed with respect to one another in an integrated termination of the ride, where the ride constitutes an upper unit, lower unit, track line, and a trolley for carrying a load, such as a zip line passenger.

In one embodiment, a tower system as an integrated, monolithic, multi-functional apparatus comprising a first base portion operating as an anchor having a mass and a surface area selected to render the first base portion effectively immovable with respect to ground therebelow, the surface area being in contact with the ground. A first tower portion may be integral and substantially homogenously formed with the first base portion to be monolithic therewith, the first tower portion extending upward away from the base portion a preselected distance vertically, defining thereby an operational height above the ground for a track line.

A first bollard portion may extend rigidly from the tower portion and be shaped to reduce stress in a track line wrapped therearound and loaded in tension. The track line may be wrapped around the bollard portion to extend in a longitudinal direction away therefrom. The bollard and the track line may both be considered to be supporting a load in tension. That load (force, stress) may be engineered and selected with the mass (and therefore weight), and surface area of the first base portion to support the load by frictional engagement of the anchor (base) while maintaining the tower system substantially immovable.

The IBAT system or tower system may include a trolley supported by the line or track line to travel in at least one of the directions away from and toward the tower portion along the track line. A second tower portion substantially homogeneously formed with a second base portion and supporting a second bollard portion extending therefrom supports the track line from an opposite end of the line. The line is wrapped around the bollard to reduce stress in the line, provide frictional engagement therebetween, and limit the bend radius of the line (e.g., wire rope).

The bulk of the first base portion and first tower portion may be formed in one or more pours of concrete, reinforced by re-bar or pre-stressed rods or cables therein. The first base portion and first tower portion may both include steel re-bar, which may be contiguous, continuous, connected, interlocking or otherwise tying the tower to the anchor (base) in a reinforcing the concrete.

The bollards may be cast in concrete also. Alternatively, the bollards may be metal structures secured by various fasteners securing the first bollard portion to the first tower portion. A second bollard or bollard portion may be opposite the first. One reason to speak of the bollard, anchor, and tower as bollard portion, anchor portion, and tower portion is because they are all fixed together to become an integrated, rigid body. That rigid body may be formed of a single material, a single construction, or assembled components.

Bollards typically include at least one of concrete, steel, reinforced concrete, and a reinforced polymeric material. Usually, they include at least two. If the bollard portion is formed substantially homogeneously with the first tower portion, it may be done as a single material, but typically as a reinforced material. For example, the first base portion and first tower portion are each comprised principally of concrete, but reinforced by steel extending contiguously therebetween. Thus, they are not strictly homogeneous, as made of a single material, but are homogeneous in that each is made of the same structural materials distributed in the same way as "reinforced concrete," for example.

A first deck (launch platform) is positioned lower than the first bollard portion, sized and spaced from the bollard portion and track line to receive and launch a rider from the first deck. A second IBAT is placed below, beyond a lower "landing deck" or landing platform.

A method of construction may include providing a tower system comprising a first base portion having a mass and a surface area selected to render the first base portion effectively immovable with respect to a supporting surface therebelow, a first tower portion, integral with the first base portion to be monolithic therewith and extending away therefrom a distance vertically to define an operational height above the supporting, and a first bollard portion, extending rigidly and orthogonally from the first tower portion. To this is provided a track line, having a first end portion wrapped around the first bollard portion to be supported thereby and extending away therefrom.

Thereupon, a trolley, riding on the track line supports a load by tensioning the track line. The distance is selected, and the shape of the surface area is selected to prevent tipping of the tower portion and base in response to the tensioning.

The use includes loading a rider on the trolley at the deck, releasing the trolley to traverse the track line extending as a catenary extending freely between the first and second bollard portions, and eventually braking the user to a halt with a spring system for braking and for rebound or recoil attenuation. Then, one may, either as an operator or a rider, unload the rider from the trolley proximate the second tower portion, on the lower landing deck. Optionally, one may detach the trolley from the track line and carry it to another subsequent line, attach it thereto, and ride the span (line) to yet another terminus.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
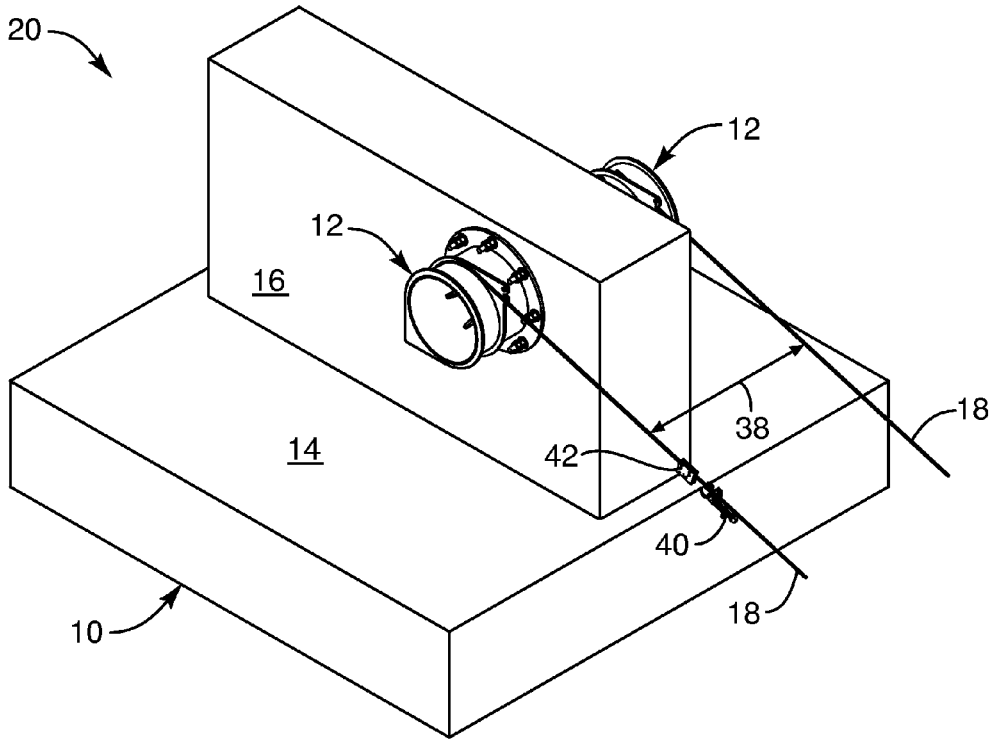
FIG. 1 is a perspective view of one embodiment of an integrated bollard, anchor, and tower (IBAT) system in accordance with the invention.
Figure 2:
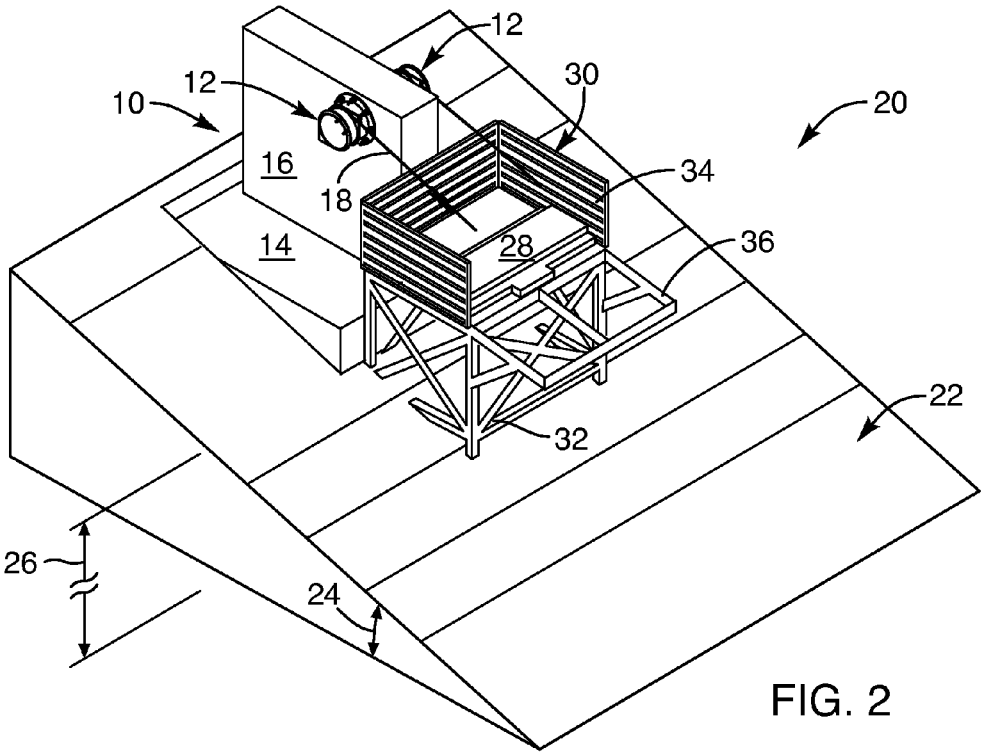
FIG. 2 is a perspective view of one embodiment thereof showing underlying terrain and a launch platform.
Figure 3:
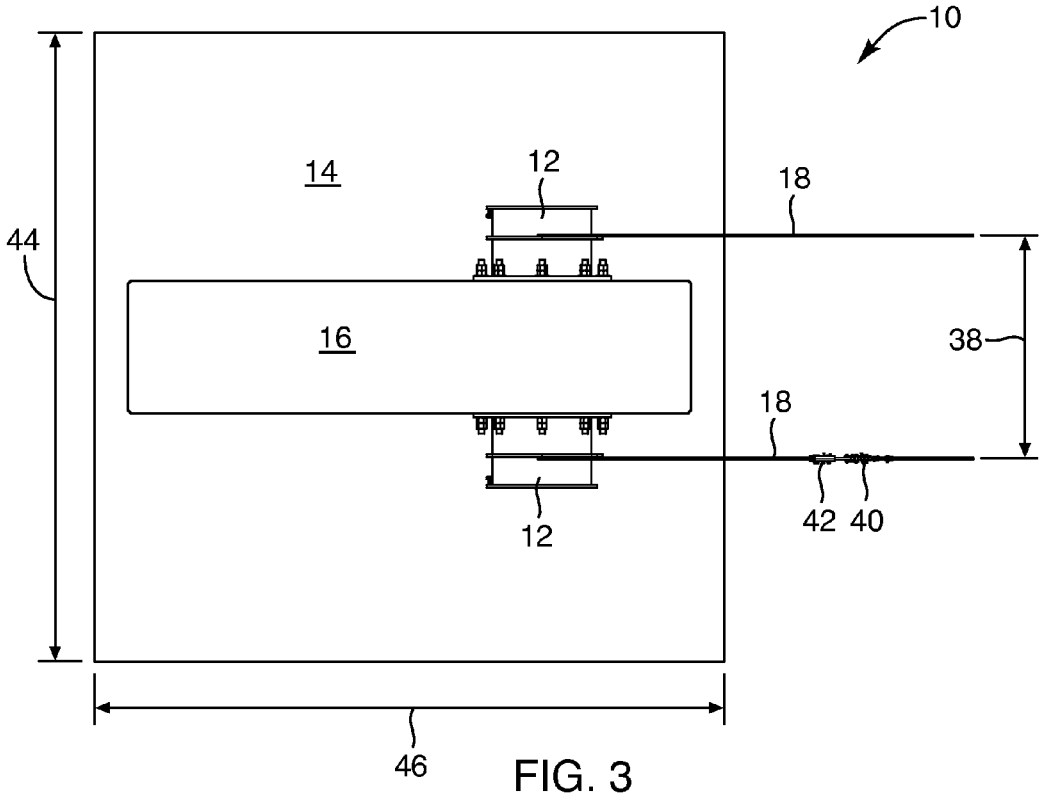
FIG. 3 is a top plan view of one embodiment of an integrated bollard, anchor, and tower (IBAT) system in accordance with the invention.
Figure 4:
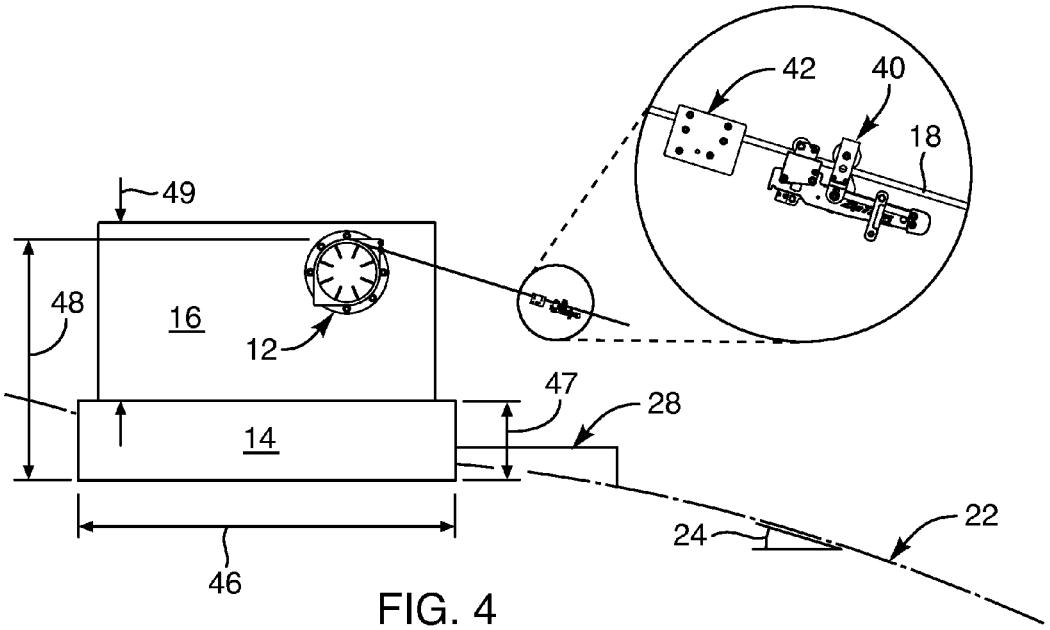
FIG. 4 is a side elevation view thereof illustrating surrounding terrain.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, an integrated bollard, anchor, and tower system (IBAT) 10 will include at least one bollard 12, and conceivably more. For example, in the illustrated embodiment, two bollards 12 are one on each side of a tower portion 16 supported on a base portion 14 or anchor portion 14. The bollards 12 flank the tower portion 16 or tower 16 symmetrically.

In the illustrated embodiment, the entire base 14 or anchor 14 and tower 16 may be formed as a single integrated component. All may be manufactured or constructed in a single pour of concrete, for example. In other embodiments, the base 14 and tower 16 may be formed in different pours, but still at a single location, such as an on-site construction.

Conceivably, the base 14 and tower 16 may be separately poured and assembled. However, several benefits may be lost thereby. For example, concrete trucks may deliver loads of concrete in steep terrain at high elevations. Obtaining stable placement for cranes is substantially more difficult. Moreover, large cranes at remote locations create many more problems than several yards of concrete in the back of a concrete mixer truck, as part of a multiple-load pour.

Referring to FIGS. 1 through 4, while also referring generally to FIGS. 1 through 15, an IBAT system 10 secures a line 18 and typically multiple lines 18. It is conceivable that the bollards 12 may extend different distances, exist at different levels (altitudes), or both. However, in the illustrated embodiments, a comparatively short distance between the bollards 12 through a tower portion 16 need only accommodate two riders and protect them against collision.

In contrast, putting other bollards 12 extending greater distances and thus including more lines 18 increases the possibility of angular rotation (yaw), loading, and so forth. One of the beauties of a system 10 in accordance with the invention is that a comparatively insignificant turning moment (as that term is used in engineering parlance, meaning a force operating at a distance, and thus creating leverage) is of very little or no consequence. Any additional length for a bollard 12 to extend away from the tower portion 16 necessarily increases the leverage, and thus the turning moment that might be exerted by a line 18 against the tower 16 and base 14 integrated with it.

Typically, the IBAT system 10 may be used in a cable ride 20, amusement ride 20, or simply a ride 20, such as a zipline, a "canopy tour," or the like. Necessarily, the IBAT system 10 must accommodate various terrain 22. Typically, the terrain 22 will have a slope 24 that varies with distance in all dimensions.

Along the surface 22 of the earth, the slope 24 may vary radically within comparatively short distances on the order of a few feet or meters. Similarly, in a distance of feet or meters to miles or kilometers, elevation may rise either gently or precipitously several times, and drop similarly. Thus, the elevation 26 at which a base 14 is installed as an anchor 14 will necessarily influence the vertical clearance required, and thus the altitude of the bollard 12 above the base elevation 26. Lateral clearance orthogonal thereto must also be engineered into a ride 20. Thus, analysis of elevation change, generally, must consider the undulation or rising and falling of the surface 22 or terrain 22 between upper and lower systems 10.

One benefit of an IBAT system 10 in accordance with the invention is the reduced profile, while still including sufficient clearance of a rider above the underlying terrain 22. For example, a base or anchor portion 14 and tower portion 16 may include thousands of pounds of weight. Unlike conventional towers used in trams, ski lifts, ziplines, and so forth, the tower 16 contributes a substantial fraction of anchoring weight, yet no high (30 feet or more) of altitude is required for the tower portion 16. Typically, from the base elevation 26 to the top of the bollard 12 or the top of the tower 16 may need only be from about 12 to about 20 feet. Greater distances are permissible. Lesser distances are permissible. However, this range has been found suitable. It provides for the height of users, the proximity of overhead lines 18 or track lines 18, and the clearance necessary between the feet of a user riding the line 18, and any collision or surface of the underlying terrain 22.

In certain embodiments, a deck 28 or platform 28 may serve as the central element of a launch station 30 near an upper reach or upper end of a line 18 or track line 18. The deck 28 may or may not require any underlying structure 32 as a support structure 32. Typically, a barrier 34, such as a railing 34, fence 34, or the like may surround the deck 28 or the entire launch station 30 in order to provide safety against falls, interference with equipment, and other safety considerations.

Similarly, a net frame 36 may support netting. Nets may also proceed or extend beyond the net frame 36. However, a net frame 36 serves to protect anyone who should fall from the platform 28 or deck 28 during loading, or immediately after launch. For example, a faulty harness, an accidental release, horseplay, inexperience, lack of care, or the like might lead to a fall, which may be rendered harmless by a suitable net secured by a net frame 36.

In the illustrated embodiment, having a pair of bollards 12 secured to a single tower 16 in an IBAT system 10 provides the benefit of symmetry. For example, by setting a distance 38 between the lines 18 on adjacent bollards 12 fixed to a tower 16, the loading by cables 18 or lines 18 is symmetric, thus removing any rotational moment in a horizontal plan or yaw component of force. Typically, the distance 38 is selected to be larger than the overall arm span (fingertip to fingertip) of the largest contemplated user. This assures that the adjacent riders will not collide with one another.

Another criterion for setting the spacing 39 or distance 38 between the lines 18 is the arc that a harness and rider would make in pivoting in a vertical plane normal (perpendicular) to the line 18. Inasmuch as it is possible with a freely rolling trolley 40 on a line 18, to swing circumferentially about the line 18 as an axis 18, a distance 38 between the lines 18 should be set to preclude collision between riders.

Referring to FIGS. 1 through 4, while continuing to refer generally to FIGS. 1 through 15, a trolley 40 will typically carry a passenger, traveling along the line 18. A passenger will typically enter into a seat or harness. An operator or the individual rider may operate a release. The release permits the trolley 40 and the rider suspended thereunder in the harness or seat (not shown) to travel downward under the effect of gravity along the suspended line 18.

One practical reality ever present is safety. Accordingly, U.S. patent Ser. No. 14/451,932 filed Aug. 5, 2014 and entitled TERMINAL-RECOIL-ATTENUATION SYSTEM AND METHOD, incorporated hereinabove by reference, discloses a launch block 42, in several embodiments for registering the trolley 40 at a launch station 30. Typically, a user will stand on the launch platform 28 or deck 28 while harnessing, connecting, or both. However, in certain embodiments, for example, in the various types of trollies disclosed in the U.S. Patents incorporated hereinabove by reference, various trollies 40 with braking systems, and various types of control over speed, braking, or both illustrate how this may be done. Thus, there is no need to repeat here all the details of how the launch block 42 cooperates with a trolley 40 to register a rider and maintain safety and security thereof.

Thus, it is entirely within contemplation for an individual user to remain in harness while walking between various lines 18 or various spans 18. A rider may simply walk to the starting point of one span from an ending point of another by removing a trolley 40 from the harness worn by the user, and removing the trolley 40 from the line 18. Thus, a user may carry the trolley 40 to another span 18, mount the platform 28, and reconnect the trolley 40 to a new line 18.

Thereupon, a user may connect to the trolley 40 by the harness and engage the new line 18 in another ride 20 along a different span across the underlying terrain 22. In certain embodiments, a user need not unclip or disconnect from the trolley. A user may simply use the available slack to set the trolley on his or her shoulder, or in a pack, and amble on over to ride a new span.

The IBAT system 10 benefits from certain dimensions. One improvement for construction of ziplines is the elimination of the use of overhead lifts. For example, in remote locations, especially inaccessible, steep, mountainsides, helicopters, and cranes are expensive, dangerous, not completely satisfactory, yet often necessary to set up conventional towers for supporting track lines 18.

In an apparatus and method in accordance with the invention, no crane is necessary. Access by trucks, tracked mountain tractors operating like snow cats, and the like can typically navigate along mountain trails, clearings, ski paths, and so forth. Concrete trucks can often navigate steep, winding, mountain roads or other passages. Thus, in one embodiment of a method and apparatus form making and using an IBAT system 10 in accordance with the invention, the base portion 14 and tower portion 16 may be formed with concrete construction techniques, laying in many yards, and thousands of pounds, of concrete.

This concrete may be reinforced by pre-stressed elements, such as pre-stressed cable (e.g., wire rope), rod, re-bar, and so forth. By whatever mechanism, the base (anchor) portion 14 and tower portion 16, constituting the bulk of size and mass provide the tower and bollard functionality. They can be installed or constructed on site by many smaller loads of concrete transported poured on site.

Figure 5:
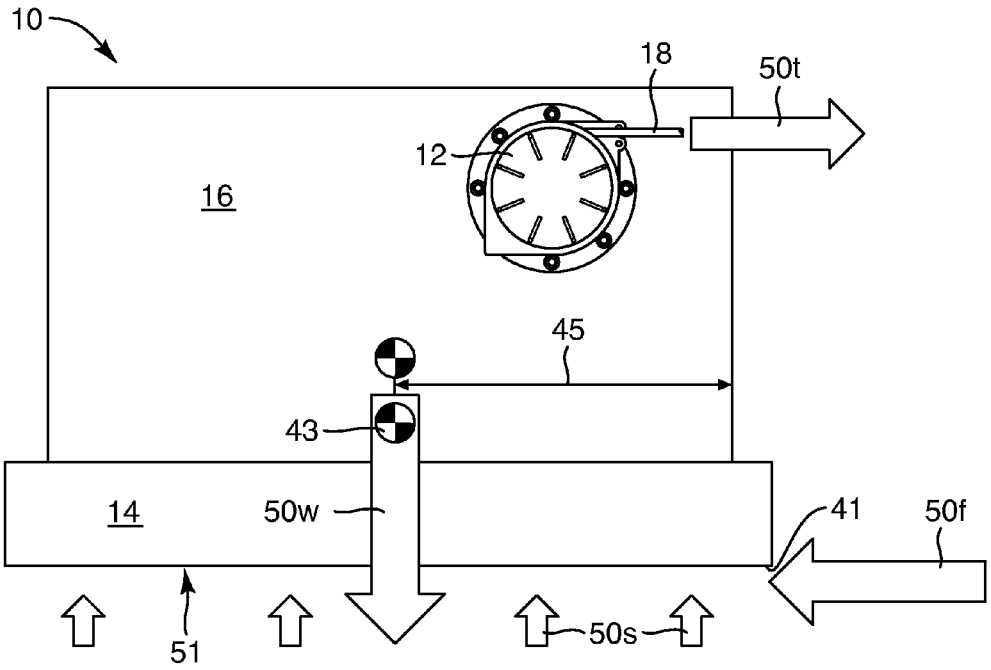
FIG. 5 is a side elevation view of a force schematic diagram illustrating the significant forces operating on an IBAT system in accordance with the invention.
Figure 6:
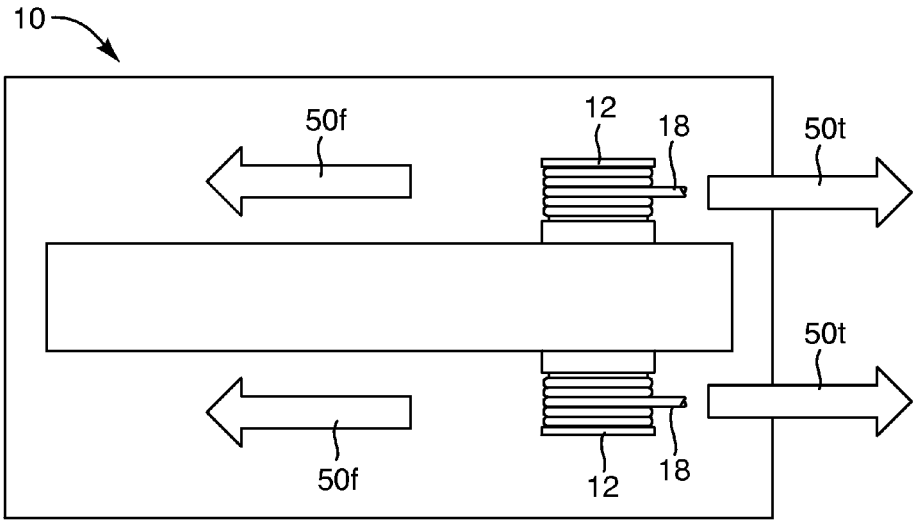
FIG. 6 is a top, plan, schematic view thereof.

Referring to FIGS. 5 and 6, while continuing to refer generally to FIGS. 1 through 15, in one embodiment of an IBAT system 10, a width 44 of the base portion 14, along with a length 46 thereof and thickness 47 may be engineered to eliminate much of the conventional geologic analysis and preparation that would have been required for conventional installations.

The width 44, length 46, and thickness 47 are selected and engineered in accord with principles of structural and materials engineering. They are calculated in combination with the height 48 at which the cable 18 or line 18 passes over the bollard 12, as well as the height 49 of the tower portion 16. Together, the total weight imposed on the supporting terrain 22 by the base 14 and tower 16 is selected to be secured by frictional forces between a level region formed in the terrain 22, and the total weight of the integrated base 14 and tower 16.

Frictional forces 50*f* are a function of normal forces 50*w* due to weight of the base 14 and tower 16. Meanwhile, the load 50*t* or tension 50*t* applied by the lines 18 over the bollards 12 urges the IBAT system 10 to slide. Since frictional force 50*f* tending to restrain the IBAT system 10 against sliding acts in opposition to that tension force 50*t* or that resolved component thereof operating directly opposite to the frictional force 50*f*, the base portion 14 and tower portion 16 may simply be sized to meet the frictional requirements.

As an engineering principle, frictional coefficients are a property of two materials with contact force and friction therebetween. Necessarily, surface roughness, materials of which surfaces are formed, and the like all have an effect on the coefficient of friction. Nevertheless, the frictional force 50*f* at which any object will slide is equal to the frictional coefficient (μ), multiplied by the normal force 50*w* or weight 50*w*. Thus, the overall weight 50*w* may be engineered to overmatch the tension force 50*t* by a "factor-of-safety" multiple. Of course, any vertical component of tension forces is resolved against the weight 50*w* or support forces 50*s* of the earth supporting the IBAT system 10.

In the illustrated embodiment, the support forces 50*s* are distributed along the lower surface 51 of the base portion 14. Similarly, the overall weight 50*w* is distributed along the entire surface 51 of the base portion 14. However, for analytical purposes, one may concentrate the total weight 50*w* at a center of gravity 43 spaced some distance 45 away from a leading edge 41 of the base portion 14. That distance 45 is calculated to resist tipping about the leading edge 41. Frictional forces 50*f* may be designed to simply reduce the need to excavate, analyze geological conditions, and the like. So long as the weight 50*w* across the surface area of the bottom surface 51 is supported and stable against settling, sliding, and tipping, there exists no need to anchor to bedrock. There is no need to form footings for a metal tower or other erected construction, or the like. Instead, the weight 50*w* assures a frictional force 50*f* sufficient to resist movement in response to the tension load 50*t*, and a rotational moment sufficient to preclude tipping.

This last consideration that the IBAT system 10 addresses is the direct result of a frontal load collinear with the horizontal component of the tension force 50*t*. For example, a vertical tower of conventional design benefits from a balance of forces between guy lines distinct from the tower structure itself. Struts, radio towers, meteorological towers, power line towers, and the like, extending hundreds of feet, benefit from a balance of forces guyed to the surrounding ground.

Similarly, large cranes extend for long distances, hundreds of feet. They are supported against bending not by their own mass or material, of the (typically) latticed structure. They are stabilized rather by the tensioning lines (guys) surrounding them. Any radio station having a broadcast tower will typically be found with a multiplicity of guy lines applying equal forces at selected locations and drawn to several surrounding and symmetric pull points on the ground. Thus, column buckling is averted by the lateral (cross ways) stabilization the guy lines provide for the main structure. Thus, the structure itself need only support the longitudinal load therethrough, with no lateral loading orthogonal thereto.

In contrast, the IBAT system 10 in accordance with the invention dispenses with the concept of guy lines and separate anchors. It does not seek to guy a tower against the load presented by the tension force 50*t* presented by the lines 18. Instead, the bollard 12 directly supports the tension force 50*t*. The bollard 12 serves to reduce and equalize tensile (tension) forces among all the strands of the wire rope 18 that serves as a line 18. The diameter of the bollard 12 is engineered to reduce to a safe and effective value the turn (bending) radius of the line 18. It also applies friction to the line 18 resisting sliding therebetween.

Meanwhile, loading is transferred from the bollard 12 into the tower 16. The tower 16 is simply a reinforced slab 16 or fin 16 of concrete in certain embodiments. Reinforcement and material connections between the tower 16 and the base portion 14 apply the weight of the base 14 (anchor 14) aggregated with the weight of the tower 16 to a total weight 50*w*. That weight 50*w* may be analyzed as operating through a center of gravity 43 to weigh down the bollard 12, and fix it against sliding, lifting, turning, pivoting (yaw), tipping (pitching), or other movement by application of a suitable weight 50*w* and frictional, resistance force 50*f*.

One aspect of the overall length 46 of the base portion 14 that also must be considered is the position of the center of gravity 43 at a distance 45 away from the front edge 41 or leading edge 41 of the base 14. Theoretically, if the weight 50*w* and the center of gravity 43 could be at an improper combination. Then the tension force 50*t* and the friction force 50*f* may introduce a couple (as that term is used in structural engineering). That couple would tend to rotate (pitch) the overall IBAT system 10 in a clockwise direction in the image of FIG. 5. However, sufficient length 46 engineered in the base portion 14, along with distributed weight engineered in the concrete, and reinforcement engineered throughout and between the tower 16 and the base (anchor) portion 14, will yield a distance 45 by which the center of gravity 43 is displaced away from the leading edge 41 of the base 14, thus resisting tipping. The anchor 14 literally anchors the bollard 12 and line 18 to the earth by weight 50*w* and friction 50*f* alone, with no need for any penetration into bedrock or even into surface soil or above other overburden bedrock.

The comparatively low profile on the order of from about 12 to about 20 feet of the IBAT system 10 needs merely an excavation to create a flat region on the brow of any hill. Any level place formed stably along a descent on a mountainside may be completely sufficient to support the system 10. Thus, the need to clear large swaths of vegetation or extend high above it, the need to employ cranes or helicopters to haul and install tall metal structures as towers, and the like have been eliminated. The overall height 48 of the matched cables 18 running over the paired bollards 12 along with the length 46, may be engineered along with the overall weight 50*w* to resist sliding (translation), tipping (pitch), turning (yaw), leaning or canting (roll), and thereby fully stabilize the lines 18.

Figure 7:
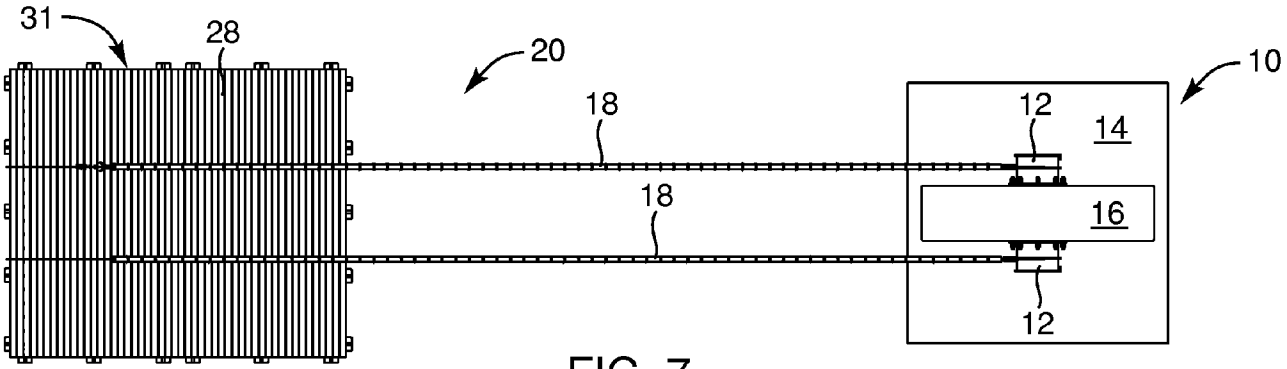
FIG. 7 is a top plan view of one embodiment of a lower terminus for an IBAT system in accordance with the invention.
Figure 8:
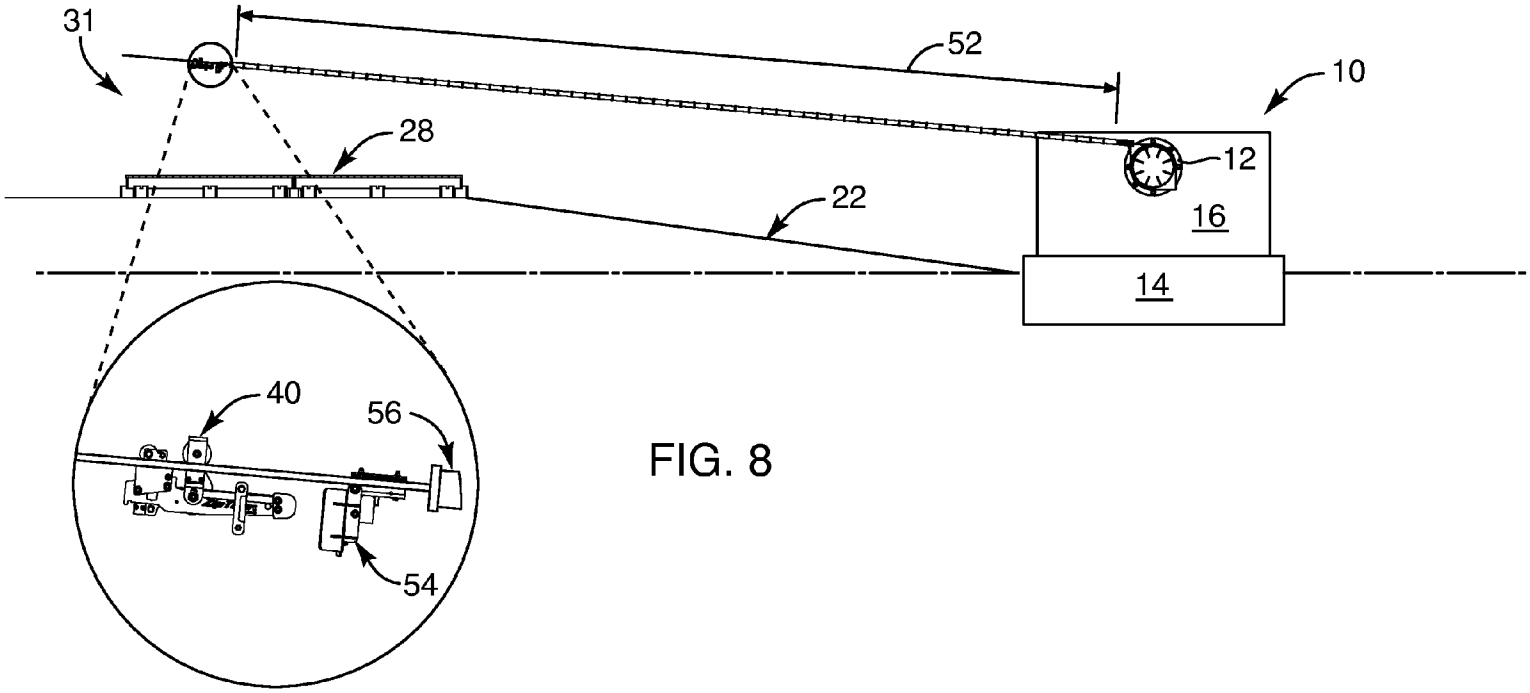
FIG. 8 is a side elevation view thereof.

Referring to FIGS. 7 and 8, while continuing to refer generally to FIGS. 1 through 15, the lower end of a ride 20 may operate in similar fashion to the upper end. Typically, the loading may be reduced, inasmuch as the integrated system 10 at the bottom of a ride 20 is below the main span and weight of lines 18, whereas the system 10 at the upper end of the ride 20 is above the cable 18. Nevertheless, the cable tension 50*t* still results at both sides from the suspension between the bollards 12 above and below.

In one embodiment, a base (anchor) portion 14, tower portion 16, and bollard 12 may stand off some distance 52 away from a landing location on a platform 28. Typically, a platform 28 is used in constructing or otherwise designating a landing station 31. It provides a consistent distance between a user and a landing platform 28. Dirt, grass, natural surroundings, and the like are subject to the vagaries of weather, especially rain, consequent mud, and so forth. Also, dirt tends to dig out and displace as a result of dust, mud, wear, and so forth. Thus, the terrain 22 may typically be covered with a platform 28 or deck 28, establishes an elevation and a longitudinal location along the line 18, which serve to fix a landing location for a user.

A braking system as described in the other references incorporated herein by reference will provide a more comfortable stopping process rather than an abrupt halt, recoil, or the like. In fact, certain embodiments of attenuation systems described in the aforementioned patent documents incorporated hereinabove by reference disclose methods of tailoring the impact forces transferred into a trolley 40 in the braking distance 52, as well as attenuating any recoil (e.g., bounce back, oscillation, etc.), or the like.

In the illustrated embodiment, the trolley 40 may be captured by a receiver 54 or acceptor 54 interfacing with a resistance (e.g., spring) mechanism 56. Again, the patent documents incorporated hereinabove by reference disclose multiple mechanisms for providing resistance systems 56 or resistance mechanisms 56, as well as mechanisms for receiving and securing a trolley 40 into a receiver 54, attenuating recoil (e.g., rebound, oscillation, etc.), and otherwise bringing a rapid yet comparatively soft braking force to the trolley 40 and its suspended rider.

Figure 9:
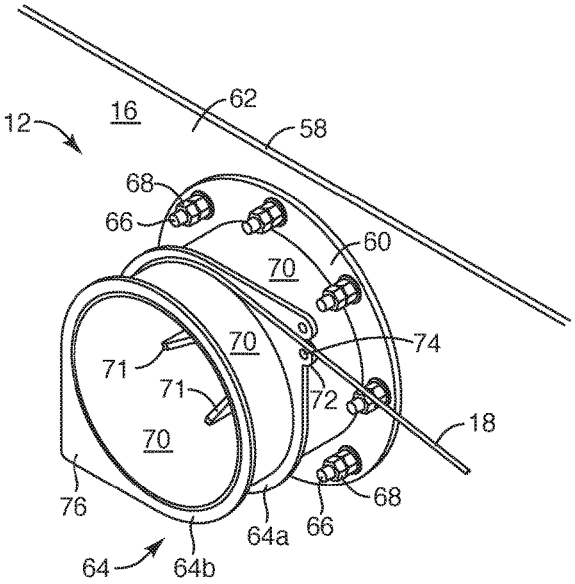
FIG. 9 is a frontal perspective view of one embodiment of a bollard in accordance with the invention.
Figure 10:
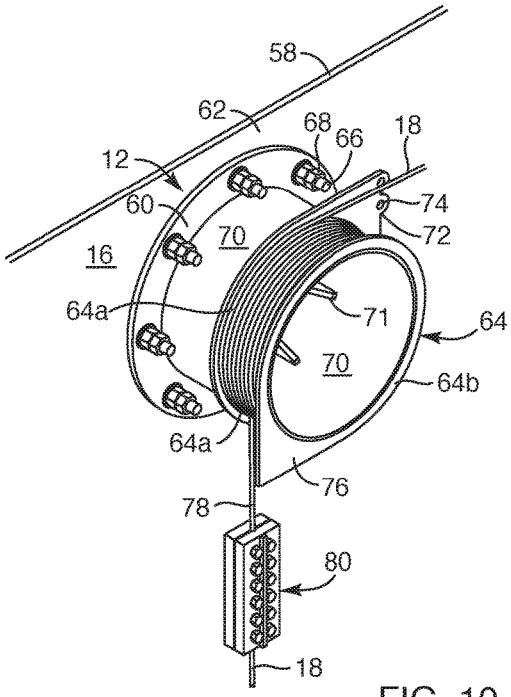
FIG. 10 is a rear perspective view thereof, illustrating the cable securement and track line (wire rope or cable)
Figure 11:
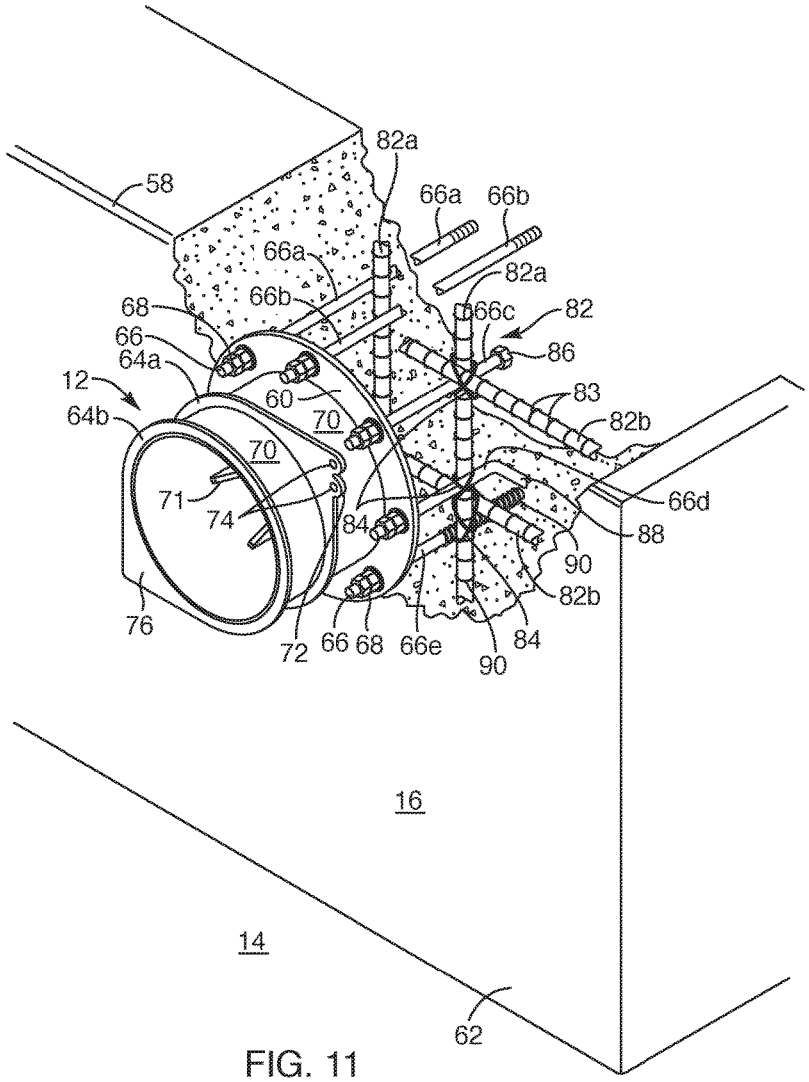
FIG. 11 is a frontal, perspective, cutaway view of a tower portion illustrating a bollard and reinforcement bar installation in accordance with the invention.

Referring to FIGS. 9 through 11, while continuing to refer generally to FIGS. 1 through 15, certain details of the bollard 12 are illustrated. In the illustrated embodiments, a bollard 12 may sit near a corner 58 as a registration position near a top of a face 62 or surface 62 forming the vertical plane at the exterior of a tower portion 16. In the illustrated embodiment, a flange 60 forming a base 60 or mounting ring 60 is typically an integral portion of the bollard 12. In one embodiment, the flange 60 fits against a face 62 or against a gasket on the surface 62 of the tower portion 16 just below the top edge 58 thereof. Also, an inner flange 64*a* and an outer flange 64*b* operate as capture flanges 64 to constrain the line 18 wrapped around the bollard 12. The bollard may, in the alternative be cast as a reinforced extension from the tower 16.

The line 18 may be initially laid against the inner flange 64*a* during installation. Meanwhile, several wraps of the line 18 (e.g., from 8 to 10 typically) around the bollard 12 distribute force, increase frictional load, reduce tensile stress in the line 18, and otherwise distribute the load. The bollard 12 does not wear any particular location on the line 18 much more than another, permits a certain amount of slipping, tightening, and so forth, that otherwise distributes the forces along a bend diameter specified by the manufacturer of the line 18.

For example, the smaller the diameter of a turn (bend) to which the line 18 is exposed, the greater disparity between the tensile force in the outermost fiber (maximum diameter) and innermost fiber (minimum diameter) of the curvature. As in all bending, the innermost surface or innermost fiber in such a turn of the line 18 may actually be in compression. Thus, the tensile forces 50*t* added to the disproportionate loading due to a "tighter" bend in the line 18 may add up to overstressing and thereby damaging the line 18. A manufacturer can specify for any cable 18 or line 18, a particular working load and (force or stress in force per unit area) and bend diameter about which it may be turned or wrapped. This is based on material properties, dimensions, and distortions tolerable while still maintaining its load rating (maximum permissible working force).

In the illustrated embodiments, the flange 60 is secured against the surface 62 of the tower 16 by bolts 66, and nuts 68. Various fastening mechanisms 66 may be used, but bolts 66 anchored within the tower 16 have been shown to be effective, and meet construction standards for engineered structures.

From the flange 60 the actual barrel 70 or core 70 that constitutes the shaft 70 or tube 70 about which the line 18 is wrapped extends away, typically at a constant diameter. The diameter may vary. However, it has not been found cost effective to vary the diameter of the drum 70 or barrel 70 of the bollard 12.

An ear 72 may extend from the inner flange 64*a*. One or more ears 72 may be provided with apertures 74 in order that the clevis and pin attachment on a hydraulic cylinder may be secured thereto. When a cable is pulled, and properly tensioned, it is possible in an apparatus and method in accordance with the invention to draw a line 18 to a predetermined tension, or position.

First securing a hydraulic cylinder by a pin through the aperture 74 in the ear 72 and then clamping the opposite end of the extended hydraulic cylinder to the line 18, the line 18 will pull toward the bollard upon closure of the length of the hydraulic cylinder. Thus, the line 18 may be wrapped around the barrel 70 of the bollard 12 without the loads of the tensile force 50*t* therein. That is, the tensile force 50*t* is supported directly by the flange 64*a* and the ear 72 thereon supporting one end of the hydraulic cylinder clamped to the line 18. Thus, operating the hydraulic cylinder, closing it to a shorter length, applies tensile forces to the line 18, bringing it into position.

The presence of two ears 72 and two apertures 74 permits the use of multiple cylinders, in order that tensioning of the line 18 may progress by stages. As one cylinder connected to one aperture 74 of one ear 72 comes closed, another cylinder may be attached to the other ear 72 at full extension length of the second hydraulic cylinder. Clamping effected by this second cylinder against the line 18, permits subsequent closure. Taking the tension off the first cylinder, enables its removal (unclamping) for re-extension and re-clamping after the second cylinder has closed up all or part of its length between the fully opened and fully closed positions. The two cylinders may trade off until proper length, position, elevation, clearance, and tension are achieved in the line 18.

In certain embodiments, the outer flange 64*b* may be provided with a corner 76 or extension 76 outside the radius of the circular portion of the flange 64*b*. For example, in the illustrated embodiment, the corner 76 is provided with a stop 78. The stop 78 serves the purpose of registering a clamp 80 securing the line 18 around the barrel 70 of the bollard 12. Once the length or span of a line 18 extending between an upper and lower bollards 12 has been established, each remaining extremity, tail, or end of the line 18 may be wrapped around the barrel 70 of the respective bollard 12, and clamped off or tied off by the clamp 80 registering against the stop 78 on the corner 76.

Referring to FIG. 11, while continuing to refer generally to FIGS. 1 through 15, certain structural reinforcement embeds opposite a bollard 12 through the face 62 of the tower portion 16. Actually, multiple embodiments illustrated rely on different mechanisms by which the fasteners 66 or anchoring bolts 66 may be secured within the wall 16 or fin 16 that is the tower 16 or tower portion 16 of an IBAT system 10.

Also of note, the barrel 70 may be selected to have a length, outer diameter, inner diameter, and material constitution engineered to support the tensile load 50*t* that will be applied thereto. To that end, in the interest of economy and safety, the section modulus of the bollard 12 may be increased by adding reinforcements 71 or gussets 71. Alternatively, the wall thickness of the barrel 70 may be increased. However, it has been demonstrated that greater stiffness with less material is provided when materials are shaped to put more material away from the "neutral axis" of a structural section and near an outermost fiber, not necessarily an equal cross section at all distances of material.

The principle of "section modulus" as used here is well understood and documented in many engineering textbooks. Section modulus is a characteristic of various shapes of mechanical structures, and demonstrates that stiffness is proportional to the base distance multiplied by a constant times the third power of the distance from the neutral axis (usually near the center of mass of the section).

Typically, the flanges 60, 64*a*, 64*b* may be welded onto the barrel 70 of the bollard 12. Casting, forging, threading other assembly techniques, and the like may also serve. However, a welded construction has been found suitable. However, it has been found more convenient to bolt the flange 60 against the surface 62 of the tower 16, after concrete pouring and setting up have occurred.

However, there are several mechanisms available for stably securing the flange 60, and thus the bollard 12, against the surface 62 of the tower portion 16. Several concepts are illustrated here. Typically, a pattern of bolts 66 may be formed and positioned to extend through the face 62. Each of these bolts 66 may penetrate some distance into the tower portion 16, or all the way through. In fact, the two bollards 12 may be preassembled or assembled on site and placed to penetrate through the forms into which the tower 16 is poured. Thus, each of the bolts 66 may represent a shaft 66 passing all the way through the tower portion 16.

One will note in the cutaway portion of the tower 16 various embodiments of reinforcement bar 82 or rebar 82. The vertical rebar 82*a* will typically be wired to horizontal rebar 82*b*. Again, note herein that any use of a reference numeral alone indicates any or every item of that name, type, or class. The same reference numeral followed by a trailing letter indicates a specific instance of that general item. Thus, it is proper to speak of all bolts 66, and of specific bolts 66*a*, 66*b*, 66*c*, 66*d*, 66*e*, and so forth.

Likewise, the rebar 82 may have specific orientations including the vertical 82*a*, the horizontal 82*b*, and others. Wire 84 is typically used for ties 84 to hold rebar 82 in place. Later on, concrete has been poured around the rebar 82, so the individual pieces thereof become rigidly fixed due to their relative positions, the rigidity of the surrounding concrete, and the texture 83 on the surface thereon. These features keep the rebar 82 in place, and fixed with respect to bolts 66 and other pieces of rebar 82. Thus, the wire 84 or ties 84 need not be particularly strong, only sufficiently strong to keep each of the lengths of rebar 82 in place until after the concrete has set.

In the illustrated embodiment, bolts 66 of various embodiments may be used alone, together, mixed, or exclusively of one type. For example, the bolts 66*a*, 66*b* are represented as through-bolts 66*a*, 66*b*. These are threaded at both ends, and proceed all the way through the thickness dimension of the tower member 16 or tower portion 16. In contrast, the bolt 66*c* is illustrated with a bolt head 86. That bolt head 86 would be anchored inside the concrete, and thus stabilize the bolt 66*c* in the longitudinal direction against motion. In contrast, the bolts 66*a*, 66*b* may be stabilized somewhat by friction, but will ultimately be stabilized in position by the presence of the nuts 68 on each end thereof, securing the flanges 60 of the respective bollards 12.

Likewise in contrast, the bolt 66*d* has a return 88 or foot 88 at one end. This tends to stabilize the bolt 66*d* in rotation or a circumferential direction about the bolts main longitudinal axis when a nut 68 is being threaded thereon, as well as in a vertical and horizontal direction. That is, in the vertical direction, and in both transverse and lateral horizontal directions (e.g., parallel and perpendicular, respectively, to the surface 62), or in both the full vertical planes and the full horizontal plane, the foot 88 provides stabilization of the bolt 66*d*.

Likewise, the ties 84 may be applied to secure the bolts 66 to the rebar or with the rebar 82. In other embodiments, the bolts 66 may be arranged in a pattern, fixed to some type of a base, and that entire base may be poured around by the concrete. Meanwhile, that base, having registered therein the alignment of each bolt 66 parallel with the others thereof, as well as registering in various other dimensions, by the location of the base, may be secured to the rebar 82 to provide a much easier installation of the flange 60 thereon.

In one alternative embodiment, the bolt 66*e* illustrates texturing 90 or threads 90 tending to stabilize the bolts 66*e* against rotation, as well as longitudinal movement. Thus, the presence of the concrete within the texture 90 tends to secure the bolt 66*e*. In other embodiments, inserts may be provided between the faces 62 of the tower portion 16 to form passages through subsequently poured concrete, through which bolts 66 may be passed to secure to the flanges 60.

Figure 12:
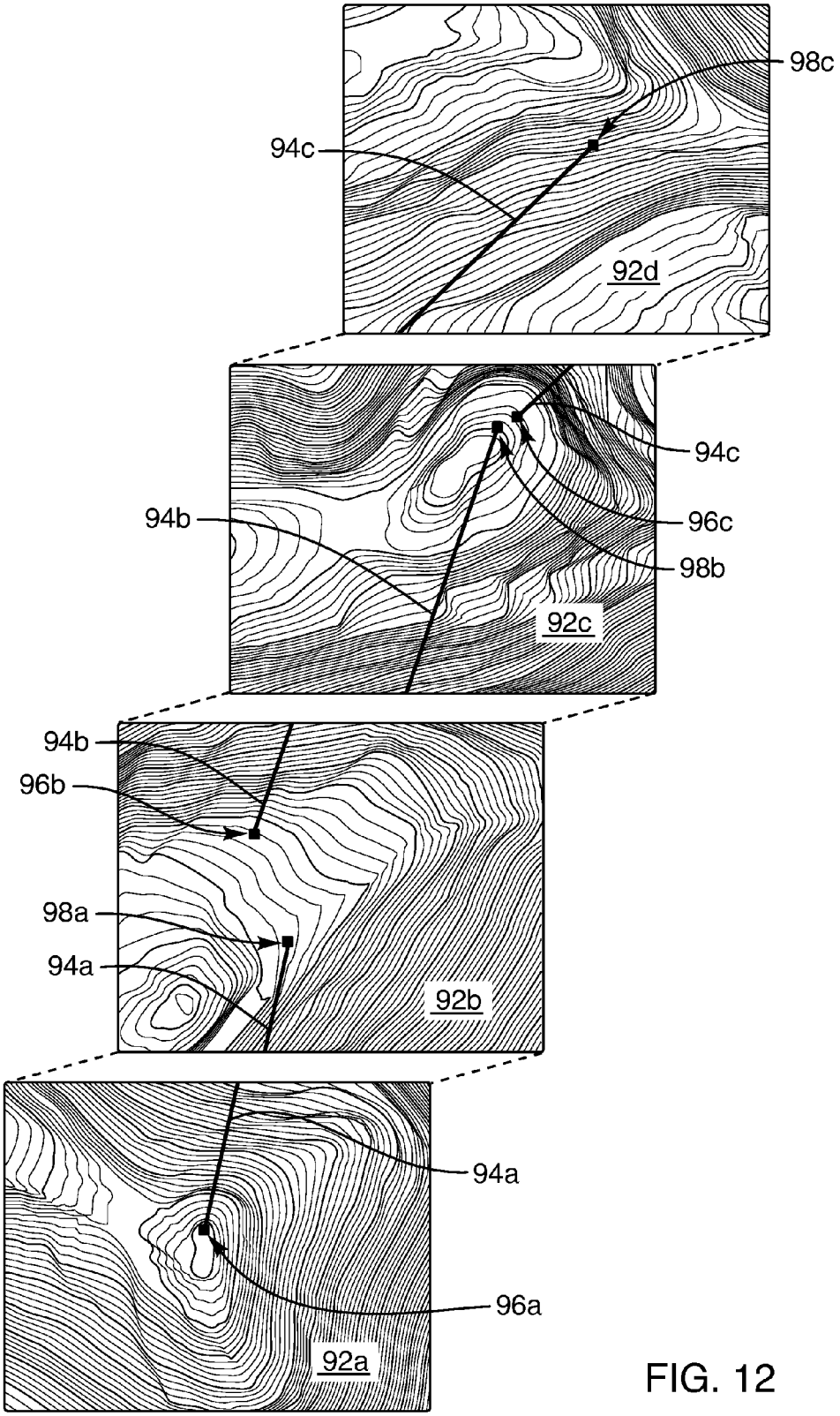
FIG. 12 is an IBAT layout on terrain in accordance with the invention.

Referring to FIG. 12, while continuing to refer generally to FIGS. 1 through 15, in one embodiment of a process for engineering and installing IBAT systems 10 a series of topographical maps 92 may be prepared representing paths or spans across various terrain 22 over which the ride 20 will operate. Various features may be seen in plan view as illustrated in the maps 92*a*, 92*b*, and 92*c*, 92*d*. One will note that each of the maps 92 represents an area where an IBAT system 10 will be installed.

In the illustrated embodiment, two IBAT systems 10 will often be installed in the area of each of the maps 92. For example, a span 94 will have an upper terminus 92 and a lower terminus 98. At each terminus, an IBAT system 10 is located. Thus, FIG. 12 represents a "canopy tour" in which various spans 94 may be traversed between adjacent terminals 96, 98 or terminae 96, 98.

Figure 13:
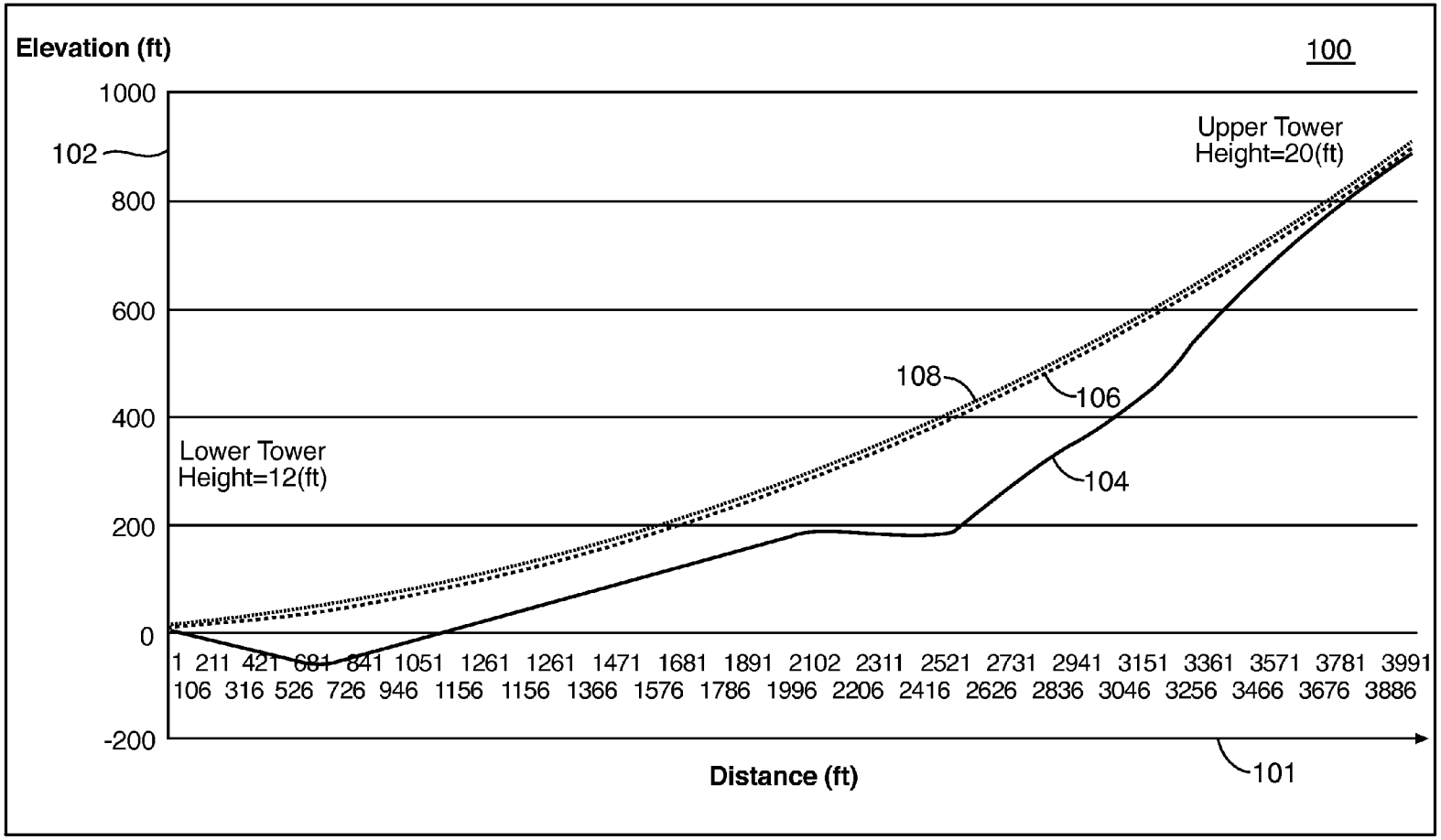
FIG. 13 is a chart illustrating relative elevations in one example of a span of an IBAT system installation on available terrain.

Referring to FIGS. 12 through 13, while continuing to refer generally to FIGS. 1 through 15, the clearance between the line 18 above a rider and the terrain 22 below a rider may be engineered by investigating various locations along the topography of FIG. 12 that will provide clear spans 94 without an obstruction. For example, the ups and downs in features of the terrain 22 may cause a cable line 18 or track line 18 to come too close to underlying terrain 22.

For example, in FIG. 13, one chart 100 prepared for data associated with a particular span 94 showed that the distance access 101 along the span 94, when plotted against the elevation axis 102 provided three profiles. The profiles included the terrain profile 104 and the rider path 106 or rider profile 106, representing the lowest point on the rider, the feet. Likewise, the line profile 108 represented the line 18 in space as tensioned.

One will notice in the particular embodiment that near the upper end or the higher elevation 102, the rider is sufficiently close to the terrain 22, that it would be advisable to fence off a region so that a standing passerby does not wander under a user, whose feet or harness may strike the standing person below. Meanwhile, near the center of the curves 104, 106, 108 a tremendous difference in elevation 102 exists between the terrain 22 and the curve 108 representing the line 18, and the curve 106 representing the lowest point of a user. One will note, however, that a brow of the terrain 22 then again projects out and approaches closer to the curves 106, 108, although never as close as illustrated in the upper reaches thereof.

In order to complete an installation, and engineer its location before installation, the topography of FIG. 12, as well as the elevation clearances of FIG. 13 need to be calculated. Safety factors should be introduced for protection of persons and equipment. However, one benefit available by the use of IBAT systems 10 is the ability of the towers 16 to position the top of the bollards 12 at a mere 12 to 20 foot distance above the installation grade elevation 26 of an IBAT system 10.

Figure 14:
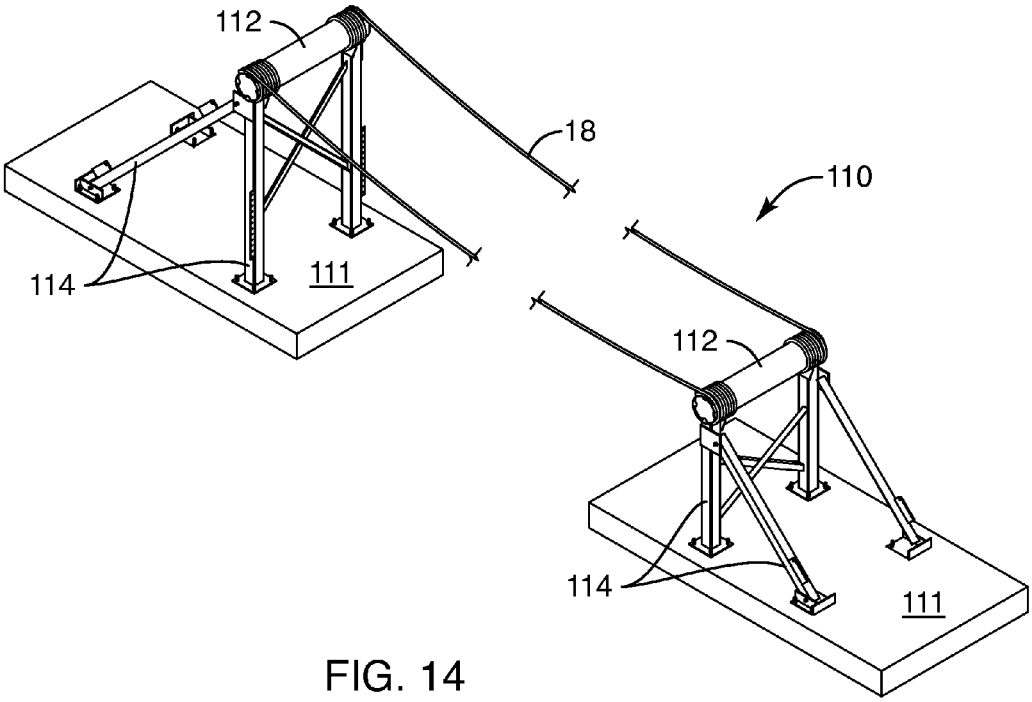
FIG. 14 is a perspective view of one embodiment of a practice tower and line system.
Figure 15:
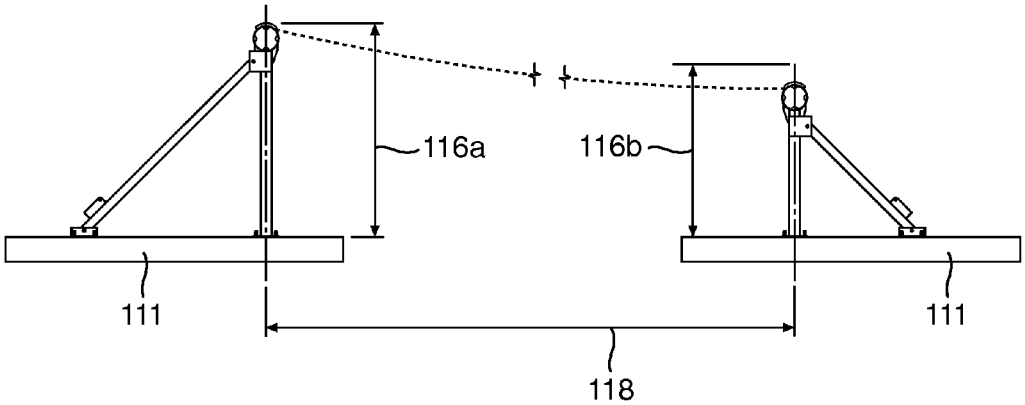
FIG. 15 is a side elevation view thereof.

Referring to FIGS. 14 and 15, while continuing to refer generally to FIGS. 1 through 15, a practice unit 110 may be installed on a pad 111 constituted by concrete, wood, bedrock, native earth, or other fixturing. Bollards 112 may be placed at opposite ends of lines 18. A simple support structure 114 may be installed in order to provide some desired amount of height differential between the elevation 116*a* or height 116*a* at the upper end or upper bollard 112*a*, and the height 116*b* at the lower bollard 112*b*.

The distance 118 between the bollards 112 may be nominal, compared to a typical cable ride 20. For example, a distance of from about 50 to about 100 feet has been found entirely suitable. In fact, a target distance of about 75 feet including between about 10 and 20 feet of a braking mechanism 56 has been found entirely suitable.

One purpose of the practice unit 110 is to permit people on a comparatively short (tens not thousands of feet) and comparatively low (feet or yards, not hundreds of feet above earth), and thus in a comparatively safe environment to practice attaching and disattaching the trolley 40. A trolley connects to a harness of a rider. It must be safely secured. Users practice attaching and disattaching the trolley 40 to and from the line 18.

Again, in the patent references incorporated hereinabove by reference, numerous details of trolley design, including interlocks, safety mechanisms, bails, plates, locks, and the like have been illustrated. Some are best adapted to more-or-less permanent attachment. That is, they do not remove readily for each ride. Others may be quickly, in a matter of seconds, secured and locked, or unlocked and removed from a line 18.

A practice area 110 assures that the differences in elevation 102 between the curves 104, 106 would not become the test of skill of a user. In the illustrated embodiment, the distance 118 may be set at about a target value of about 75 feet. This provides the experience, easy walk back distances 118 after each ride, and a suitable test, without any particular high level of risk.

Benefits accruing to an IBAT 10 in accordance with the invention are plentiful. An IBAT 10 is distinct from conventional systems for anchoring track lines and other lines for trams, lifts, ziplines, canopy tours, ski lifts, and so forth.

For example, the base 14 or anchor portion 14 serves as a longitudinal datum anchoring, tensioning, and supporting the line 18. It also provides vertical support for the tower portion 16 and the bollard 12 secured thereto. Also, the base portion 14 or anchor 14 spreads as a footing across a sufficiently large area that no other footings, guys, or pilings are required. Rather, the anchor 14 serves as a pad that has been poured and reinforced such that it needs no underlying footings, only its native, undisturbed, underlying ground. This has implications for limiting the geological analysis, testing, and preparation required.

Reduced soil testing and analysis are required. As a practical matter, only the loading requirement and the ability of the underlying soil to support load that impose any significant requirement on the soil conditions under the anchor 14. Likewise, there is reduced geological interface, preparation, and so forth. Soils need not be disturbed.

Drilling is not required. Excavation is not required other than sufficient to provide a flat surface. The remaining geological material under the anchor 14 is undisturbed, and thus compacted, well settled, and stable. There is no need to dig to bedrock.

By the same token, there is no requirement to anchor into bedrock, drill, excavate to bedrock, or dig down to engage the bedrock with buried pilings or other structures. Thus, there is no need to maintain, inspect, replace, and otherwise monitor and maintain any buried structures. Similarly, there is no need to anchor into bedrock with some base length of lever arm or guy line in order to prevent tipping. Guy lines are no longer required in a system 10 in accordance with the invention.

Instead, the anchor 14 operates on the basis that the frictional force is equal to the coefficient of friction multiplied by the normal force (weight 53) of the system 10. Of course, the overall weight 53 will include the benefit of the tower portion 16 as well. Accordingly, a bed of crushed rock will provide suitable engagement of the anchor portion 14 with the soil, and thus provide a coefficient of friction suitable to resist lateral or longitudinal forces (with respect to the line 18) in any horizontal direction.

Since no footings are required underneath, less excavation, results, because depth is effectively an irrelevant parameter. This will almost always simplify construction. An anchor 14 in accordance with the invention will fit on any brow of a hill, with a simple crushed rock interface. Moreover, reduced preparation of the surface, because the surface is left undisturbed, need only involve sufficient excavation to form a flat region. Moreover, an artificial "brow" of any hill may be created by a simple excavation into the side of the hill. Thus, an anchor 14 or base portion 14 in accordance with the invention may be located at virtually any suitable location position on a hillside or mountainside.

Suitable engineering is required for the dimensions of length of the anchor 14 in the longitudinal direction of the cable 18, width in a lateral direction orthogonal to the horizontal vector or direction of the cable 18, and a vertical direction. Thereby, the size, weight 50*w*, or 53, and leverages may resolve all tipping forces or tipping moments created by the tension of the line 18 pulling against the bollards 12 on the tower portion 16. Moreover, the frictional forces 50*f* as discussed hereinabove resolve any sliding forces 50 due to the tension applied by the line 18 against the bollard 12 and anchor 14. All are ultimately resolved through the tower 16 and anchor 14 against the ground.

Another benefit is the monolithic structure of the entire IBAT system 10. The anchor portion 14 may be poured with and reinforced with the tower portion 16. The bollard 12 may either be cast or fastened to the tower portion 16. Thus, a monolithic IBAT system 10 provides a smaller footprint of affected ground area, reduced height, positioning at a location along a mountain, and particularly any brow presenting itself, or the like. Even when the brow or flat on the side of a mountain is created by excavation, the underlying soils are undisturbed, and have often been so for centuries if not millennia. A simple crushed rock surface treatment will prepare the flat region of the underlying soil to receive the poured anchor 14 or base portion 14.

The reduction of overall footprint by the anchor 14 itself, as well as any supporting and surrounding accessories assures low environmental impact. Appearance, color, shape, and so forth are easily obscured within the nap of the earth, and particularly matched within surrounding foliage. A large metallic structure extending above foliage is no longer necessary. In most embodiments, the IBAT system 10 at the top of a line 18, and the IBAT 10 at the bottom of the line 18 may be virtually identical. Thus, comparatively low profile, with no need to dig significantly lower into the surface of the soil provides low impact, low profile, low visibility, and so forth. In most embodiments, additional digging does not improve loading, compaction, or the tower positioning.

Since the anchor portion 14 is often placed on already stable, centuries-settled, compacted ground, no forces of settling, tipping, sliding, or the like are sufficient to move it. Typically, the vertical thickness of the anchor portion 14 may be from about three to about eight feet. It has been found that a target thickness of about five feet on approximately a 21 foot square (plan view) provides a suitable anchor portion 14. This may use from about 40 to about 100 yards of concrete. Typically, the anchor portion 14 with proper dimensioning requires about 75 yards of concrete.

The tower 16 may extend from about 8 to about 16 feet above the upper surface of the anchor portion 14. This will depend on the installation. However, it only represents from about 20 to about 50 yards of additional concrete. The thickness of the tower 16 may be from about three to about six feet, and is typically on the order of about four to five feet. A target value of about four and a half feet has been found suitable with a volume of about 24 cubic yards of concrete. Meanwhile, a height of about eight feet, placing the top of the bollard 12 at about seven feet above the anchor portion 14 has been found a suitable target distance.

Meanwhile the tower 16 serves as a vertical datum. As a monolith with the anchor portion 14, the tower portion 16 provides symmetric loading with no need for guys, also called guy lines. At such a reduced height of the tower 16, stability is not a problem against tipping. The length of the anchor 14 and tower 16 may simply be calculated along with their thicknesses and heights to provide sufficient mass to reduce the moment that the lines 18 can apply thereto. In other words, the mass and weight along with the dimensions of the anchor 14 and tower 16 as well as the positioning of the bollard 12 control the resistant to tipping and thus prevent tipping of the IBAT system 10 by the line 18.

No conventional 40-foot tower is required, no wide-area guy lines, reduced environmental impact, shorter distances of affected areas, and so forth all benefit the environmental acceptability of a tower 16 in accordance with the invention. The installation footprint is much less than a conventional installation, and a loading deck 28 need not be towered.

That is, the loading deck 28 need not be positioned on top of the tower 16 as in conventional installations. Instead, the loading deck 28 may have a very low environmental impact, a low profile, may be substantially identical at upper and lower ends, and may be substantially at ground level. Clearances for foliage, safety, and so forth can be accommodated within the dimensions discussed hereinabove. Thus, the shape, size, height, length, and so forth required to position the bollard 12 at its optimal location, provide for a weight and tipping moment of the IBAT 10.

It 10 will conveniently remain fixed to support the lines 18 on the bollards 12. Meanwhile, during construction, no transport of a 40-foot tower by helicopter or other mechanical means construction and lifting to an elevation 3,000 feet above a base, or the like, is required. The expense of the tower structure and its high cost installation are eliminated.

The braking section is typically on the order of from about 40 to about 100 feet, with a target value of about 65 feet. The braking region may be less, but a 65-foot target for the length of a braking section above the lower IBAT system 10 has been found suitable.

Meanwhile, the extension of from about eight to about sixteen feet, placing the bollard 12 or the top of the bollard 12 at about seven feet to about fifteen feet above the anchor 14 has been found suitable. Foliage may be trimmed to some minimal extent in order to reduce the need to completely remove foliage along the ride path. Alternatively, from the brow of a hill, proper placement of the anchor 14 and tower 16 require minimal impact on foliage to provide a clear path for a rider suspended on the line 18.

The bollard 12 may be configured in an arbitrary diameter according to the size of the line 18 and the requirements the manufacturer thereof puts on the bend radius thereof. The bollard 12 may be fastened to an embedded rack of bolts 66, or through-bolts 66, which may be cast into the tower 16. Bolts 66 may be connected or positioned such that they obtain the benefit of the reinforcement 82 or rebar 82 embedded within the tower 16.

In certain embodiments, the bollards 12 may be wrapped with line 18 that is not under tension. For example, as described hereinabove, the line 18 may be drawn by a hydraulic cylinder, providing non-tensioned, unstressed, end portion of the line 18 to be wrapped around the bollard 12. It is clamped securely to be held by the stop 78 on the corner 76 of the bollard 12.

By having identical bollards 12 on opposing sides of the tower 16, the balanced forces resulting will eliminate any tendency to yaw. Meanwhile, the frictional forces are also calculated to resist such movement.

The bollards 12 may actually occupy any arbitrary positioning in space about the tower 16 that may be desired. Thus, toward a position near the front of the tower 16 may provide more clearance for a rider, but near the back of the tower 16 may also be selected as a location of the bollard 12. However, the proportions illustrated hereinabove have been found suitable and within the engineering calculations required for mechanical stability.

Meanwhile, construction of the bollards 12 and installation thereof as described hereinabove result in an elimination of the cost of manufactured installation of a distinct bollard system according to the prior art. Again, no separate geological analysis, and indeed a reduced geological analysis corresponding to the anchor 14 is all that is required to support the bollard 12. The strength and forces of the bollard 12 need only be matched to the line 18, and supported by the tower 16. No separate, independent bollard system must be created, located, and prepared for with its own geological analysis.

The bolts 66 may actually be doubly safe if manufactured as through-bolts. They could thereby not be worked loose or moved inasmuch as they would be part and parcel of the tower 16, and secured with the rebar 82 therewithin. Nevertheless, anchored by any of the mechanisms discussed hereinabove, the bolts 66 may be aligned and secured within the tower 16. They may or may not be directly anchored directly to the reinforcing bar 82, inasmuch as they will be anchored to the reinforcing bar 82 by the intervening concrete of the tower 16.

Typically, channel clamps 80 will be used to bolt the line 18 in fixed relation to the bollard 12. That is, a clamp 80 secured by the stop 78 at a corner 76 of a bollard 12 provides a minimum stress, with no turn radius in the line 18. Meanwhile, the symmetric loading of the paired bollards 12 on either face 62 of the tower 16 provides symmetric loading without guys. About seven passes or loops or turns of the line 18 are typically made around a bollard 12. Clamping 80 is typically done at a force about double the load rating of the line 18. A channel clamp 80 is typically preferred wherein two blocks provided with a channel in each are aligned and bolted together with the cable running down the channels in each. Thus, no kinking, bend radius, or the like is imposed on the length of the line 18 or cable 18 clamped thereby.

The loading platform 28 has additional benefits in that it may be low, virtually at ground level or within the nap of the earth. It can be placed below or above an upper or lower IBAT 10, respectively, near a tower 16 clear of foliage, or adjacent the tower 16 directly. It may be positioned on stilts or other supporting structure in order to clear foliage below. Alternatively, it may benefit from the clearing of foliage nearby in order to provide a clear path for a rider to pass to or from the loading platform 28 or deck 28 along the path of the line 18.

There is no need to "tower" the deck 28, or place it on top of a tower 16. Rather, it may be separate from a tower 16. It is found along the path between the matched upper and lower towers 16 securing the opposing top and bottom ends of the line 18. By having the loading deck 28 or landing deck 28 distinct from the tower 16. Also, less structural requirement is made on the tower 16, and less structural requirement is made on the deck 28 associated with a launch station 30 or landing station 31.

Typically, a landing station 31 or a launch station 30 may be from about 15 to about 30 feet square or rectangular. With room for two lines 18 and riders and access by a worker from both sides, it should be at least 12 feet and preferably more than 15 to 18 feet across for maximum safety clearance. Typically, a target dimension of about 20 to 21 feet square has proven suitable. Typically, the level of the deck 28 is about eight and a half feet below the line 18 traveling thereabove. This provides clearance for a user, but access for a rider or attendant placing a trolley 40 on the line 18 or removing it therefrom.

Typically, a braking distance of about 65 feet between a loading or landing position on a deck 28 and the adjacent lower bollard 12 has been found suitable. A braking distance of from about 40 to about 100 feet is easily tractable. A target distance of about 65 feet has been found highly suitable, to provide a suitably soft landing, with an optimum rate of deceleration and attenuation of any rebound.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A tower system as an integrated, monolithic, multifunctional apparatus comprising:

a first base operating as an anchor having a mass and a surface area selected to render the first base effectively immovable, by reason of friction directly with respect to ground therebelow, the surface area being in contact with and on top of the ground;

a first tower, integral and substantially homogenously formed with the first base to be monolithic therewith, the first tower extending away from the base a distance vertically, defining thereby an operational height above the ground;

a first bollard, non-rotatable with respect to, and extending rigidly from the tower and shaped to reduce stress in a track line wrapped therearound and loaded in tension; and the track line, wrapped around the bollard to extend away therefrom supporting a load in tension selected with the mass and surface area of the first base to support the load while maintaining the tower system substantially immovable.

2. The tower system of claim 1, further comprising a trolley supported by the line to travel in at least one of the directions away from and toward the tower along the track line.

3. The tower system of claim 2, further comprising a second tower substantially homogeneously formed with a second base and supporting a second bollard extending therefrom to support the track line wrapped therearound.

4. The tower system of claim 3, wherein a material forming the first base and first tower is concrete.

5. The tower system of claim 4, wherein the first base and first tower each further comprise steel in a reinforcing configuration within the concrete.

6. The tower system of claim 5, wherein the first bollard is removably secured to the first tower.

7. The tower system of claim 6, wherein the first bollard comprises at least one of concrete, steel, reinforced concrete, and a reinforced polymeric material.

8. The tower system of claim 7, wherein the first bollard is formed of a material in common with the first tower.

9. The tower system of claim 1, wherein the first base and first tower are each comprised principally of concrete and reinforced by steel extending contiguously therebetween.

10. The tower system of claim 9, wherein:

the tower system further comprises a first deck positioned lower than the first bollard, sized and spaced from the bollard and track line to receive and launch a rider from the first deck.

11. A tower system comprising:

a first base having a mass and a surface area selected to render the first base effectively immovable with respect to a supporting surface therebelow due to friction acting directly therebetween;

a first tower, integral with the first base to be monolithic therewith and extending away therefrom a distance vertically to define an operational height above the supporting surface;

a first bollard, extending rigidly, non-rotatably, and orthogonally from the first tower;

a track line, having a first end wrapped around the first bollard to be supported thereby and extending away therefrom; and a trolley, riding on the track line to support a load by tensioning the track line.

12. The tower system of claim 11, wherein the base and tower are substantially homogeneously formed.

13. The tower system of claim 12, further comprising:

a second tower substantially homogeneously formed with a second base and supporting a second bollard extending orthogonally therefrom to support the track line having a second end wrapped therearound.

14. The tower system of claim 12, wherein a material forming the first base and first tower is concrete.

15. The tower system of claim 11, wherein;

the first base and first tower each further comprise reinforced concrete;

the tower system further comprises fasteners securing the first bollard to the first tower; and the first bollard comprises at least one of concrete, steel, reinforced concrete, and a reinforced polymeric material.

16. The tower system of claim 11, wherein:

the first bollard is formed substantially homogeneously with the first tower;

the first base and first tower are each comprised principally of concrete and reinforced by steel extending contiguously therebetween.

17. The tower system of claim 11, wherein:

the tower system further comprises a first deck positioned at a distance below the first bollard, the distance being selected to space the deck from the first bollard and track line to receive thereon and launch therefrom a rider;

the tower system further comprises a second tower substantially homogeneously formed with a second base and supporting a second bollard extending orthogonally therefrom to support the track line, having a second end wrapped therearound.

18. A method comprising:

providing a tower system comprising a first base having a mass and a surface area selected to render the first base effectively immovable with respect to a supporting surface therebelow due to friction acting directly therebetween, a first tower, integral with the first base to be monolithic therewith and extending away therefrom a distance vertically to define an operational height above the supporting surface, and a first bollard, extending rigidly, non-rotatably, and orthogonally from the first tower;

providing a track line, having a first end wrapped around the first bollard to be supported thereby and extending away therefrom;

providing a trolley, riding on the track line to support a load by tensioning the track line;

wherein the distance is selected, and the shape of the surface area is selected to prevent tipping of the tower and base in response to the tensioning; and wherein the base and tower are substantially homogeneously formed.

19. The method of claim 18, further comprising:

providing a second tower substantially homogeneously formed with a second base and supporting a second bollard extending orthogonally therefrom to support the track line having a second end wrapped therearound.

20. The method of claim 18, wherein:

a material forming the first base and first tower is concrete;

the first base and first tower each further comprise steel reinforcing the concrete, the steel extending contiguously therebetween;

the tower system further comprises fasteners securing the first bollard to the first tower;

the first bollard comprises at least one of concrete, steel, reinforced concrete, and a reinforced polymeric material;

providing a first deck positioned at a distance below the first bollard, the distance being selected to space the deck from the first bollard and track line to receive thereon and launch therefrom a rider; and loading a rider on the trolley at the deck;

releasing the trolley to traverse the track line extending as a catenary extending freely between the first bollard and second bollard; and unloading the rider from the trolley proximate the second tower.

* * * * *